US008018227B2

(12) United States Patent
De Monte et al.

(10) Patent No.: US 8,018,227 B2
(45) Date of Patent: Sep. 13, 2011

(54) DEVICE AND METHOD FOR MEASURING AND MONITORING THE LEVEL OF LIQUID METAL IN A CRYSTALLISER

(75) Inventors: Stefano De Monte, Colugna (IT); Stefano Spagnul, Aquileia (IT)

(73) Assignee: Ergolines Lab S.R.L., Padriciano, Trieste (IT)

( * ) Notice: Subject to any disclaimer, the term of this patent is extended or adjusted under 35 U.S.C. 154(b) by 599 days.

(21) Appl. No.: 12/162,259

(22) PCT Filed: Jan. 26, 2007

(86) PCT No.: PCT/EP2007/000701

§ 371 (c)(1),
(2), (4) Date: Jul. 25, 2008

(87) PCT Pub. No.: WO2007/085481

PCT Pub. Date: Aug. 2, 2007

(65) Prior Publication Data

US 2008/0282792 A1 Nov. 20, 2008

(30) Foreign Application Priority Data

Jan. 27, 2006 (IT) ..... PN2006A0005

(51) Int. Cl.
*G01N 27/72* (2006.01)
*G01R 33/12* (2006.01)

(52) U.S. Cl. ..... 324/228

(58) Field of Classification Search ..... None
See application file for complete search history.

(56) References Cited

U.S. PATENT DOCUMENTS

| | | | |
|---|---|---|---|
| 3,366,873 | A | 1/1968 | Miller et al. |
| 4,138,888 | A | 2/1979 | Linder |
| 4,441,541 | A | 4/1984 | Block |
| 4,529,029 | A | 7/1985 | Block |
| 4,647,854 | A | 3/1987 | Yamada et al. |

(Continued)

FOREIGN PATENT DOCUMENTS

EP 0010539 A1 4/1980

(Continued)

OTHER PUBLICATIONS

Rohac, J. et al., "Use of electromagnetic measuring of the level of the bath of liquid steel through emissions into the continuous casting ingot mold", Stahl and Eisen, Mar. 16, 1992, pp. 89-91, vol. 112, Nr. 3, Dusseldorf, DE.

*Primary Examiner* — Roberto Velez
(74) *Attorney, Agent, or Firm* — Ecker Seamans Cherin & Mellott, LLC; Carol A. Marmo, Esquire

(57) ABSTRACT

A device and method for measuring the surface level and/or the presence of a molten metal bath in a cooled container, particularly a crystallizer for a continuous casting process, comprising a source of an electromagnetic field, wherein said source of an electromagnetic field is a transmission coil fed with electrical energy at a predetermined frequency. The information on the level and/or the presence of said surface level is obtained by processing the total impedance (Z), as measured on said transmission coil, in order to calculate the contribution to said impedance (Z) of the currents induced in the walls of the crystallizer, which depend on temperature of the crystallizer and, from it, the value of said surface level and/or the presence of the molten metal bath.

12 Claims, 7 Drawing Sheets

U.S. PATENT DOCUMENTS

| | | | |
|---|---|---|---|
| 6,337,566 | B1 | 1/2002 | Fujisaki et al. |
| 6,517,604 | B1 | 2/2003 | Kim et al. |

FOREIGN PATENT DOCUMENTS

| | | | |
|---|---|---|---|
| EP | 0087382 | A1 | 8/1983 |
| EP | 0150670 | A2 | 8/1985 |
| EP | 0192043 | A1 | 8/1986 |
| EP | 0312799 | A1 | 4/1989 |
| JP | 58053363 | | 3/1983 |
| JP | 61111752 | | 5/1986 |
| JP | 11304566 | | 11/1999 |
| JP | 2002113567 | | 4/2002 |
| WO | 2005/037461 | A1 | 4/2005 |

DEVICE AND METHOD FOR MEASURING AND MONITORING THE LEVEL OF LIQUID METAL IN A CRYSTALLISER

FIELD OF THE INVENTION

The present invention relates to a device and a method suitable to allow the measurement of the level or height of meniscus in a continuous melting process of steel into ingot moulds for continuous casting, in a very accurate and reliable manner, and with a high measuring frequency.

The invention is applicable to all cases in which the liquid metal and/or the crystalliser are suitable to cooperate with a magnetic field which concerns them and which, as a consequence, generates induced currents.

The present invention also allows to detect the presence or the absence of the liquid metal in the reading field of the device.

While in the following description, for sake of simplicity, we preferably refer to the cooling and solidification step of a continuous casting of molten steel in an ingot mould, it is understood that the present invention is able to be applied also to the measurement of a molten metal bath in any kind of suitable container.

BACKGROUND INFORMATION

It is known that, during a continuous casting process, the determination of the level of the meniscus of the molten steel and of the detachment point of the liquid phase from the ingot mould, i.e. the beginning of the solid skin, is one of the most difficult problems for effective and timely process monitoring.

Indeed, the beginning of the solid skin, i.e. the closed solidified metal envelope which tends to increase its thickness progressively down along the ingot mould and which contains the liquid metal still in a molten state, is formed slightly under said level, and at the wall of the ingot mould due to the forced cooling of the latter.

If the level of the meniscus is not constantly and precisely monitored to eventually adjust the flow of molten steel and the steel extraction rate, the surface level of the molten steel bath may vary also quickly; such variations frequently give rise, as known in the art, to break-downs of the surface of the solid skin, which in practice interrupt the ability of the skin itself to contain the inner molten steel without leakages.

In general, such break-downs generate drawbacks which are described in detail in International Patent Application WO 2005/037461, to which reference is made in the present disclosure; this document also quotes discloses some further documents of the state of the art and discusses their features, such as, for example, JP 11304566A2.

EP 0312799 A1 discloses a device for measuring the level of the liquid in a crystalliser which makes use of at least one transmission coil fed by a medium-frequency electrical source and of a receiving coil. Said coils are arranged within the ingot mould body and are electromagnetically coupled to a wall of the crystalliser and to the inner volume of the same.

The operating principle of the above device is based on the fact that the information concerning the level of liquid in the ingot mould derives by processing the signals generated by said receiving coil, which depend on the mean temperature of the walls of the crystalliser, which may be in turn correlated, with known means, to the level of the liquid itself.

However, this solution, although efficient in certain conditions, presents some drawbacks which cannot be overcome: firstly, the presence of at least three coils, of which one is a transmission coil and two are receiving coils, is required; this fact naturally implies not only higher costs and construction complexity of the crystalliser provided with that device, but also requires a more complex and therefore less reliable processing of the signals present in the three coils.

Moreover, and this is the main drawback of that solution, the signal generated in the receiving coils is affected by the temperature of the coils themselves which, although protected by a metallic envelope, during operation reach the temperature of the cooling liquid which is never constant and which may vary during the casting, therefore also modifying the temperature of the coils.

Since the phase between voltage and current in the two coils depends in essence on the final voltage induced on the pick-up coil (the one closest to the copper wall of the crystalliser), it may be expressed according to either the voltage $V_{V1}$ of the most distant coil or the voltage $V_{V2}$ of the closest coil.

In essence, the phase shift between said two voltages, which we call generally "Df", may be expressed as:

$$\Delta\phi = f(V_{V1}, V_{V2})$$

Therefore, it is understood that by varying the ohmic resistance of the coils, the respective voltages will vary, both in terms of absolute value and phase; since the physical system is implicitly non-symmetric, then the voltage variations will not be equal for the two coils.

Indeed, by assuming $$V_{V1} = Asen(\mathrm{wt} + \phi V_{V1})$$

$$V_{V2} = Asen(\mathrm{wt} + \phi V_{V2})$$

with A and B respective constants, the phase difference induced between the two voltages will be:

$$\Delta\phi = sen^{-1}(V_{V1}/A) - sen^{-1}(V_{V2}/B)$$

It is therefore apparent that in case of non-perfect symmetry, there will be a phase variation also when an only ohmic variation occurs.

Finally, since said ohmic resistances depend on the temperatures of the two respective coils, which are immersed in the cooling fluid, and since the temperature of said cooling fluid may vary rapidly and in an uncontrolled manner, it logically results that the temperature and consequently the ohmic resistance of the two coils also vary, and finally the phase shift between the signals of the latter varies, which ultimately causes wrong information on the level of the liquid metal in the continuous casting.

In conclusion, since the asymmetry of the physical system is implicit within the system itself, such asymmetry is extended also to the measurement process and therefore represents a defect in the respective measurement method.

From other patents, e.g. U.S. Pat. No. 4,138,888, EP 0 192 043, U.S. Pat. No. 3,336,873, U.S. Pat. No. 6,517,604, U.S. Pat. No. 6,337,566, U.S. Pat. No. 4,647,854, EP 0 010 539, EP 0 087 382, U.S. Pat. No. 4,441,541, U.S. Pat. No. 4,529,029, solutions are known which employ coils which generate electromagnetic fields for detecting the height or level of the meniscus in a continuous casting ingot mould; however, the systems disclosed therein provide the use of at least two separate coils, and therefore suffers from the same drawbacks.

In accordance with what is stated beforehand, it is therefore the object of the present invention to realize a device for measuring the level of the meniscus of liquid steel in an ingot mould in a continuous casting process, and a related method, which overcome the above described drawbacks.

Furthermore, the device according to the invention is easily manufactured and operable with materials and components available in the art and therefore cost-effective.

These objects, with other features of the present invention, are achieved by means of a device and a method according to the appended claims.

SUMMARY OF THE INVENTION

These needs and others are satisfied by the present invention which is directed to a device for measuring the surface level and for the presence of a molten metal bath in a cooled container. As an aspect of the invention, a device is provided for measuring the surface level and/or the presence of a molten metal bath in a cooled container, particularly a crystalliser for a continuous casting process, comprising a source of an electromagnetic field, wherein said source of an electromagnetic field is a transmission coil fed with electrical energy at a predetermined frequency, and wherein:

said transmission coil is a single transmission coil with a substantially flat shape attached to only a portion of a wall of said crystalliser, substantially astride to the foreseen level of the liquid bath in the crystalliser, having a main axis substantially perpendicular to the main axis of said crystalliser, said coil is energized by an electrical signal at a frequency between 10 to 200 Hertz, and the information on the level and/or the presence of said surface level is obtained by processing the total impedance (Z), as measured on said transmission coil, which acts also as a receiving coil, in order to calculate the contribution to said impedance (Z) of the currents induced in the walls of the crystalliser, which depend on temperature of the crystalliser and, from said contribution to said impedance (Z), the value of said surface level and/or the presence of the molten metal bath.

BRIEF DESCRIPTION OF THE DRAWINGS

The present invention may be carried out according to a preferential, non limitative preferred, non-limiting embodiment described herein in detail and illustrated by a non-limiting example with reference to the attached drawings, in which.

DETAILED DESCRIPTION OF SOME PREFERRED EMBODIMENTS OF THE INVENTION

Figure 1:
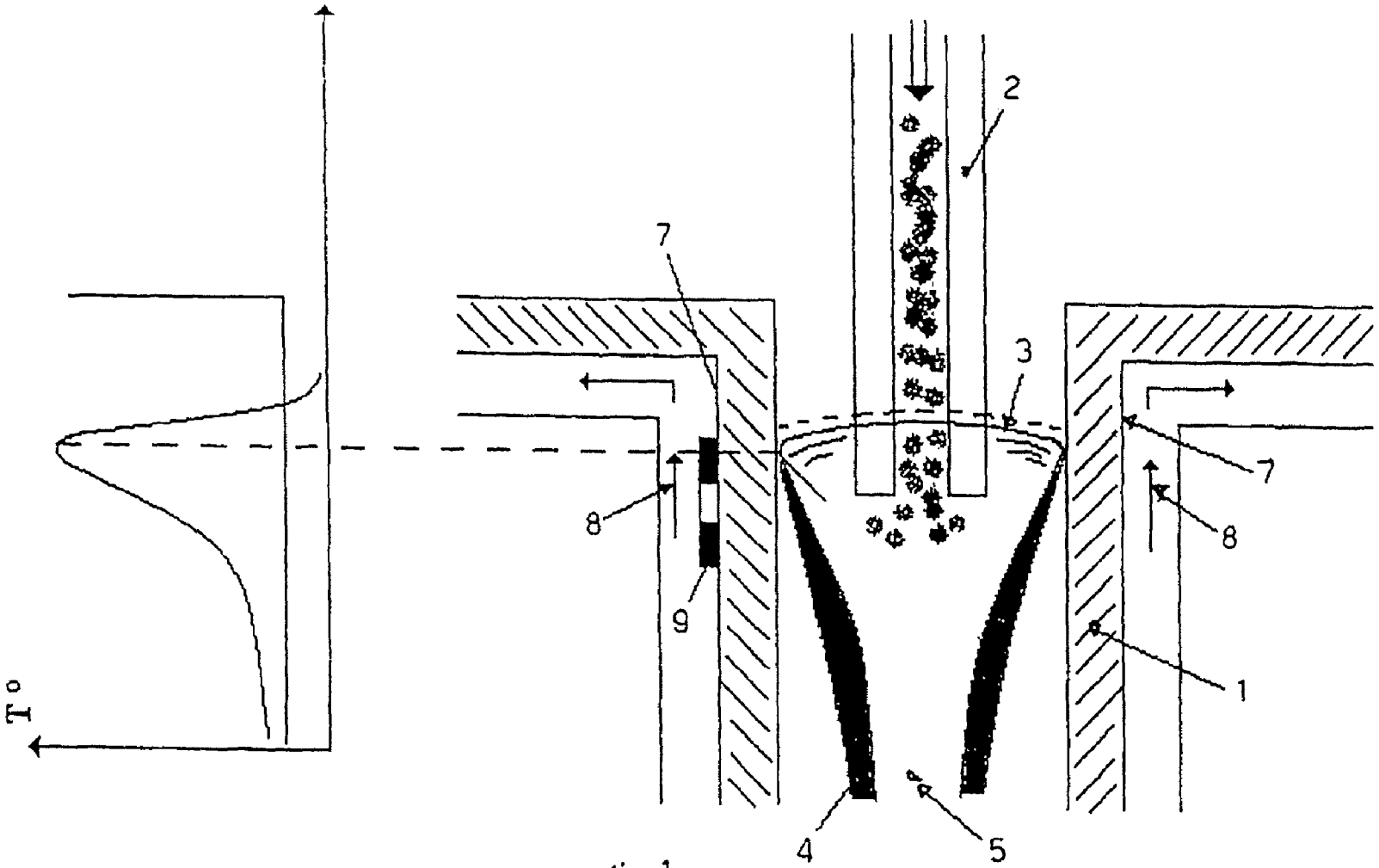
FIG. 1 shows a diagrammatic sectional view of an ingot mould according to the state of the art.
Figure 2:
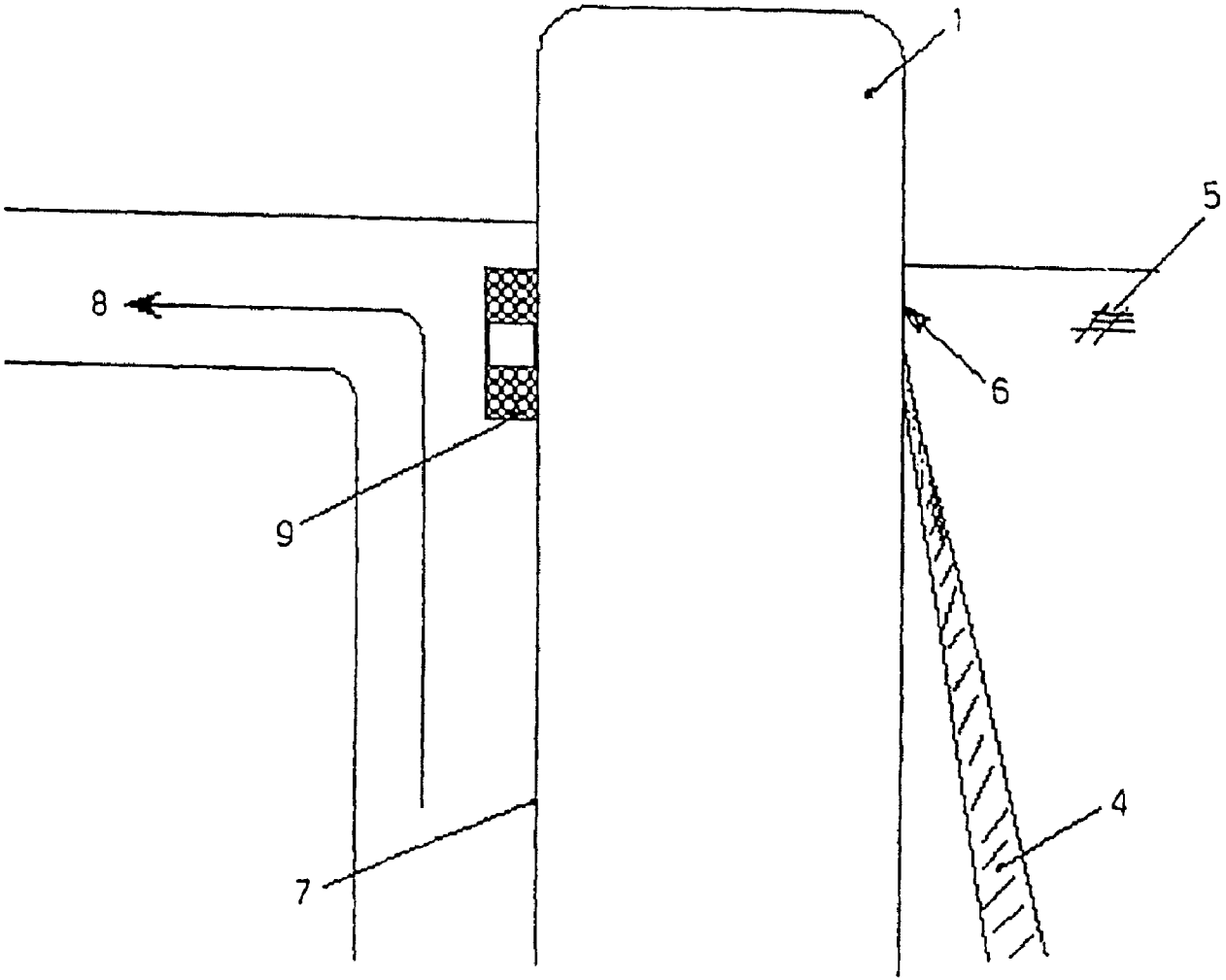
FIG. 2 shows an enlarged view of a vertical section portion of an ingot mould provided with a device according to the invention.

With reference to FIGS. 1 and 2, it is disclosed an ingot mould in vertical section wherein it may be observed:

the crystalliser 1;

the snorkel 2 for pouring the liquid steel inside the crystalliser 1;

the slag 3;

the solidified steel "skin" 4;

the steel metal in liquid status 5;

the meniscus 6;

the external liner 7 contacting the cooling fluid 8.

The present invention is essentially based on the phenomenon that the height or level of the meniscus remarkably affects the temperature of the corresponding portion of the crystalliser 1, and that the temperature of the latter, generally made of copper, is in turn affected by its electrical resistivity "r".

Therefore, a change in the temperature of the copper wall of the crystalliser 1, due to the presence of the liquid metal 5 in contact with it, causes a variation in the resistivity "r" of the copper itself.

If the crystalliser 1 is concerned by a primary electromagnetic field generated by an appropriate transmission coil fed with a variable current at an appropriate frequency, for example in the range between 10 to 200 Hertz, currents known in the art with the name of "eddy currents" are generated therein, whose nature and origin are well known.

The eddy currents generate in turn a secondary electromagnetic field, which propagate according to the Maxwell's laws and may be intercepted by one or more receiving coils, in which an electromotive force is naturally induced.

Said "eddy currents" depend on certain parameters, which include:

the current present in the transmission coil, the geometric configuration of the various components of the system, the frequency of the variable current, the electrical conductivity of the material, i.e. the copper, or any other electrically conductive material with which the crystalliser is made.

While the first three parameters do not depend on the temperature of the crystalliser, the fourth one, i.e. the electrical conductivity of copper, instead does depend as said above.

Therefore, the secondary electromagnetic field, which is affected by the temperature of the crystalliser, is generated and consequently represents the level of the meniscus.

By examining and comparing the electromotive forces in the receiving coil and the features of the current present in the transmission coil which has generated the primary electromagnetic field, it is therefore possible to detect the electromagnetic field generated by the "eddy currents", and from it the temperature the temperature of the crystalliser and finally the height of the meniscus.

Heretofore it is the state of the art, described in particular in the mentioned patent EP 0 312 788EP 0 312 799.

According to the present invention, a transmission coil 9 is considered, which, when electrically energized by an electrical signal at a suitable frequency, preferably between 10 to 200 Hertz, emits a primary electromagnetic field which concerns the upper part of the crystalliser 1; by effect of this fact, this in turn emits a secondary or reaction electromagnetic field, which is different from the primary electromagnetic field in its modulus and phase; the two fields, primary and secondary, are of course summed and a total current, which presents proper features with respect to the voltage, is induced in the transmission coil 9, and may be measured at its terminals, also by effect of said secondary electromagnetic field.

According to the invention, the transmission coil 9 has a small size, is attached only on a portion of a wall of the crystalliser, has a substantially flat shape, and a main axis substantially perpendicular to the main axis of the crystalliser 1 which coincides with the direction of movement of the liquid steel inside the crystalliser.

The following relation is considered:

$$Z=R+jX$$

This is the general formula of an impedance, where R represents the component "in-phase" with voltage, and X represents the component "in quadrature".

This formula of the impedance Z may of course be applied also to define the total impedance present in the transmission coil, also due to the secondary electromagnetic field.

However, a circumstance which is at the basis of the present invention has been observed, i.e. the fact that both the in-phase R component and the in quadrature X component of the impedance Z are not constant, but each of them depends to a certain extent on the contribution of the presence of the copper crystalliser 1.

Any conductive material presents this feature and that its effect on the vectorial features of the impedance depends on the electrical conductivity.

For this reason, the in-phase R component of the impedance of copper is much higher than that of the steel with which it is in contact. Furthermore, if the material also presents magnetic properties, then such effect is amplified by the relative magnetic permeability value. The relation described above may be written as follows:

$$Z=R_{DC}+R_{eq}(CU)+j(X_{air}+X_{Cu}),$$

where $R_{DC}$ represents the pure ohmic resistance of the coil 9, $R_{eq}$(Cu) represents a resistive contribution which derives from the secondary or reaction electromagnetic field; this contribution is due to the fact that well-known surface currents (skin effect), whose effect is represented as an equivalent resistance, are generated in a coil concerned by a secondary electromagnetic field.

It should also take in be taken into account the reactance of a ghost coil placed in a specular position with respect to the copper wall, and consider the copper as an infinite half space with infinite conductivity; however, the weight of such a factor is entirely negligible for the practical purposes of the present invention, and therefore it will be ignored.

The specular position is obtained by placing the coil 9 substantially astride the foreseen level of the liquid bath inside the crystalliser and attached to one side only of a portion of the wall of the crystalliser. Contrary to this arrangement, a coil or a series of coils which embrace all the wall of a crystalliser astride the level of the meniscus and have an axis coaxial or parallel to the main axis of the crystalliser cannot obtain such specular condition and therefore cannot obtain precise and reliable measurements.

In an embodiment, the equivalent resistance $R_{eq}$(Cu) depends on the "eddy currents" induced in the crystalliser, and consequently on its resistivity, and therefore on its temperature, and ultimately on the level, and of course on the presence, of the meniscus of the liquid steel inside on it and in the reading field of the coil 9.

A similar explanation may also be given for $X_{air}$, i.e. the pure reactive component, determined by the fact that the reactance of the transmission coil 9 also depends on said surface currents, that the phase of the secondary electromagnetic field is not the same as that of the primary field, and that this phase depends on said "eddy currents", and therefore, again, on the temperature of the crystalliser 1.

Indeed, in air, without the crystalliser 1, the previous formula becomes simply:

$$Z=R_{DC}+j(X_{air})$$

It has also been observed that, during the course of in-depth experiments and test measurements, the two components related to the crystalliser effect vary in an appreciable proportional manner, i.e. that:

$$R_{eq}(Cu)=kX_{Cu}$$

where k is a constant.

Figure 3:
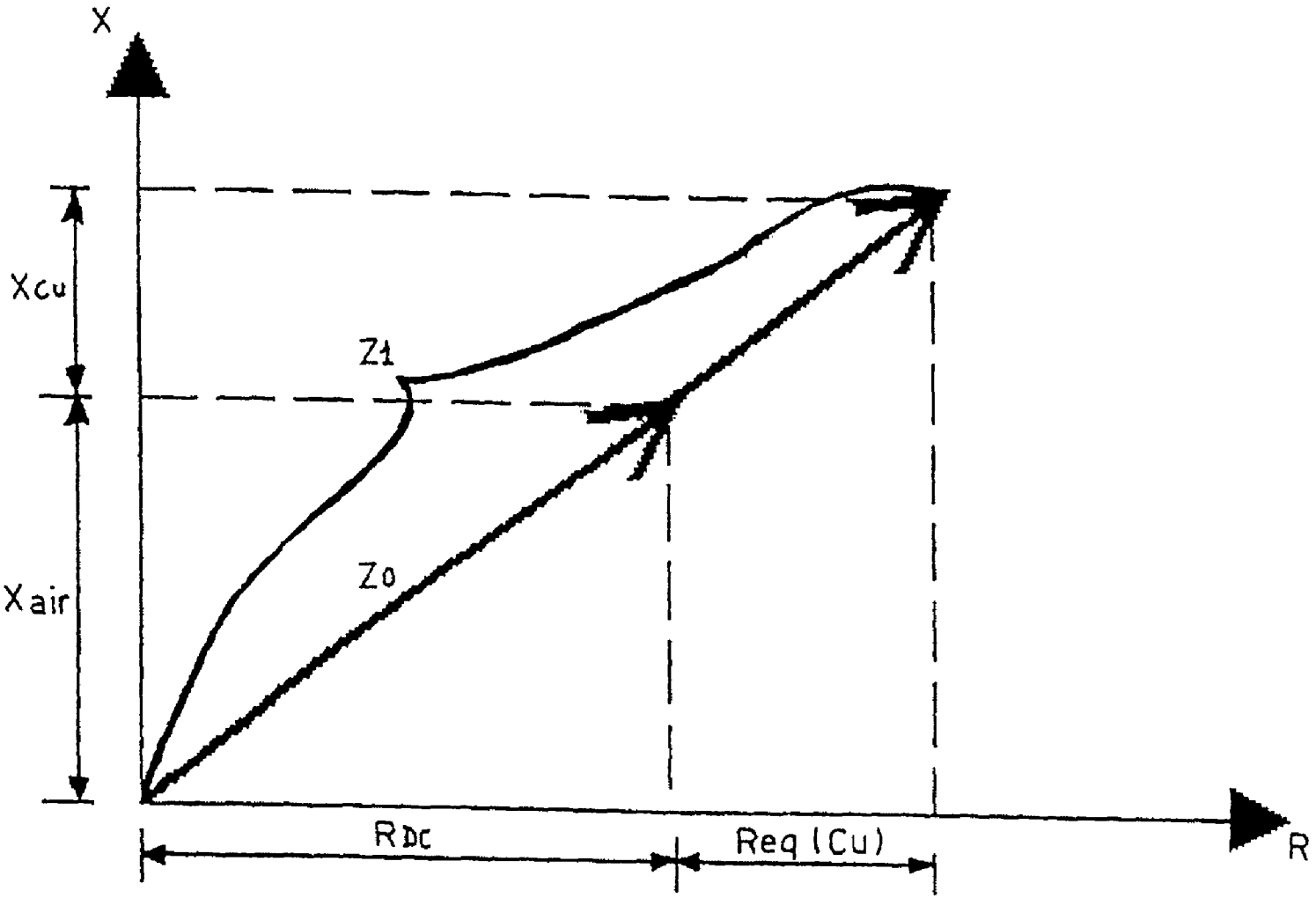
FIG. 3 diagrammatically shows the impedance vectors of the coil according to the present invention, broken down into the respective resistive and reactive components, in two distinct operating components.

With reference to FIG. 3, a diagrammatic representation of such phenomenon is shown, in that if the vector "$Z_0$" represents the impedance of the coil 9 in air, and the vector "$Z_1$" represents the impedance of the coil 9 associated with the crystalliser 1, then it is observed that said vector "$Z_1$" nearly perfectly overlaps vector "$Z_0$" having the same phase, but different module.

It is therefore apparent that, if the phase of the impedance of the transmission coil 9 were examined, no difference of phase would be found if this is either in air or in the crystalliser.

Therefore, all tests on possible differences of phase would not provide useful information.

And finally, the compared analysis of the two components, in-phase and in quadrature, would provide the sought information on resistivity and thus on the temperature of the crystalliser.

However, if the temperature of the coil 9 is varied, for example by effect of a variation of the temperature of the cooling liquid in which it is immersed, only the ohmic component of the resistance $R_{DC}$ would vary, while the other three components would remain unchanged.

Figure 4:
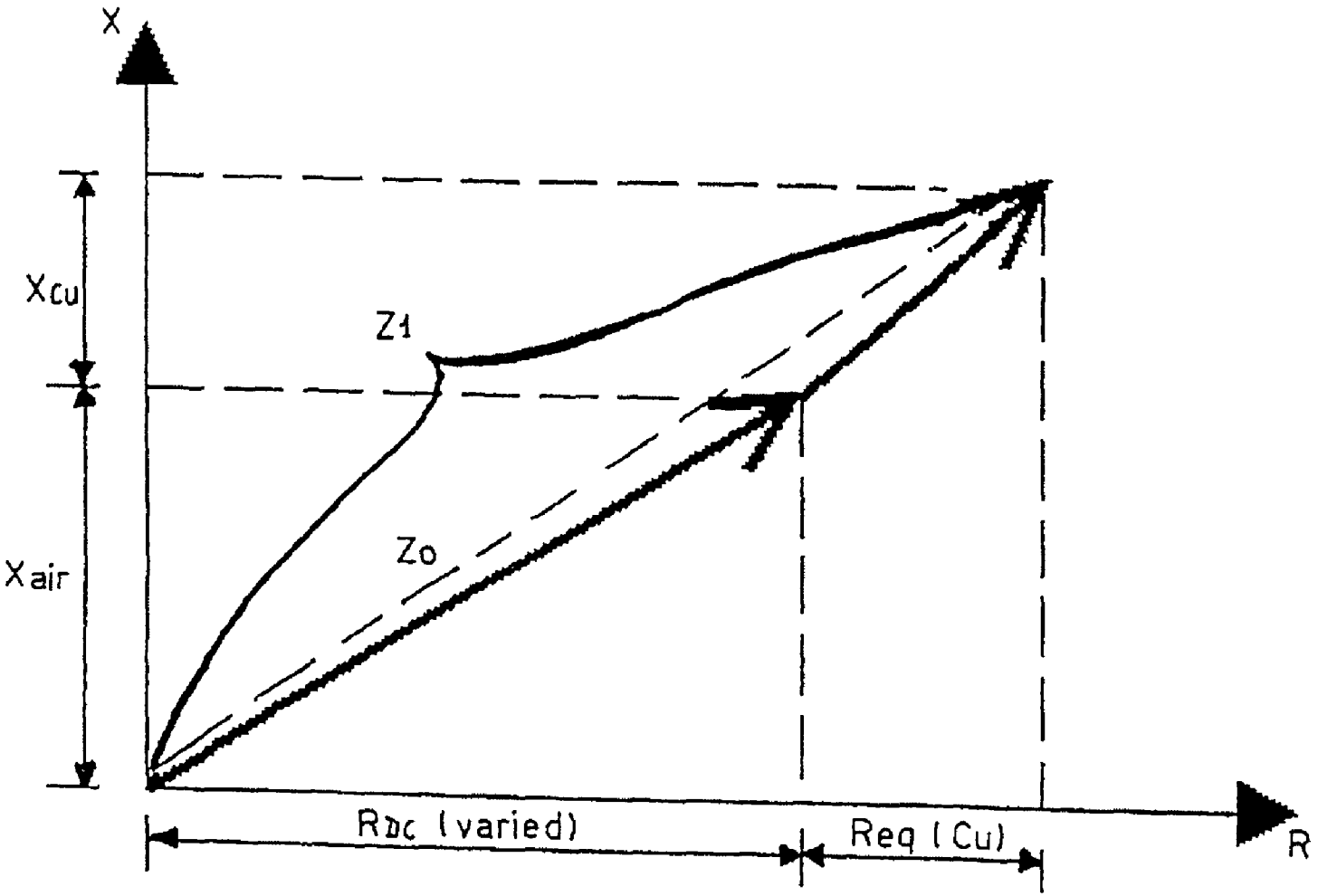
FIG. 4 diagrammatically shows the vectors of FIG. 3, in which is overlapped an impedance vector detected with a different coil temperature.

Therefore, in this case, FIG. 3 would be transformed in FIG. 4.

That is, a difference of phase would occur which would affect the measurement, because a phase which depends also on the temperature of the coil 9, and not only on the level of the meniscus, would be measured.

Since the ohmic component of the resistance $R_{DC}$ is responsible for the above discussed problem, the present invention is based on the fact that by simply eliminating such factor, i.e. ignoring said ohmic component of the resistance $R_{DC}$, and calculating the temperature of the crystalliser 1 only based on the reactive components $j(X_{air}+X_{Cu})$, it is possible to obtain the required information.

In fact, having identified and selected said reactive component, it will be sufficient to compare it with predetermined values, which comprise respective heights of the meniscus, to identify with simple means and methods, the level (height) of the meniscus in the measured situation.

For this purpose, it will suffice to perform an ordered series of experiments, in which the different heights of the meniscus are associated to corresponding values of said reactive components $j(X_{air}+X_{Cu})$ to easily identify the sought height with the required accuracy.

Other methods for associating the height of the meniscus to said reactive component $j(X_{air}+X_{Cu})$ are available, such as for example by the processing of suitable algorithms, but such general techniques are well-known in the art and therefore will not be explained below.

As concerns the determination of said reactive component, it will be sufficient to the total impedance Z and the phase shift angle "f" between the current and the voltage present at the terminals of said transmission coil 9 will be measured according to knows known methods and therefore to calculate said reactive component $j(X_{air}+X_{Cu})$, which is equal to the sine of the total impedance, $$j(X_{air}+X_{Cu})=Zsen\text{ “}f\text{”}.$$

While at least two coils, one transmission coil and one receiving coil, are used in the prior art, only one coil is used according to the present invention.

According to the present invention, the temperature of the crystalliser 1 is correlated to the reactive component of the impedance of the single coil 9, and not to the relation between the phases of the two coils, as happens in the prior art methods.

Figure 5:
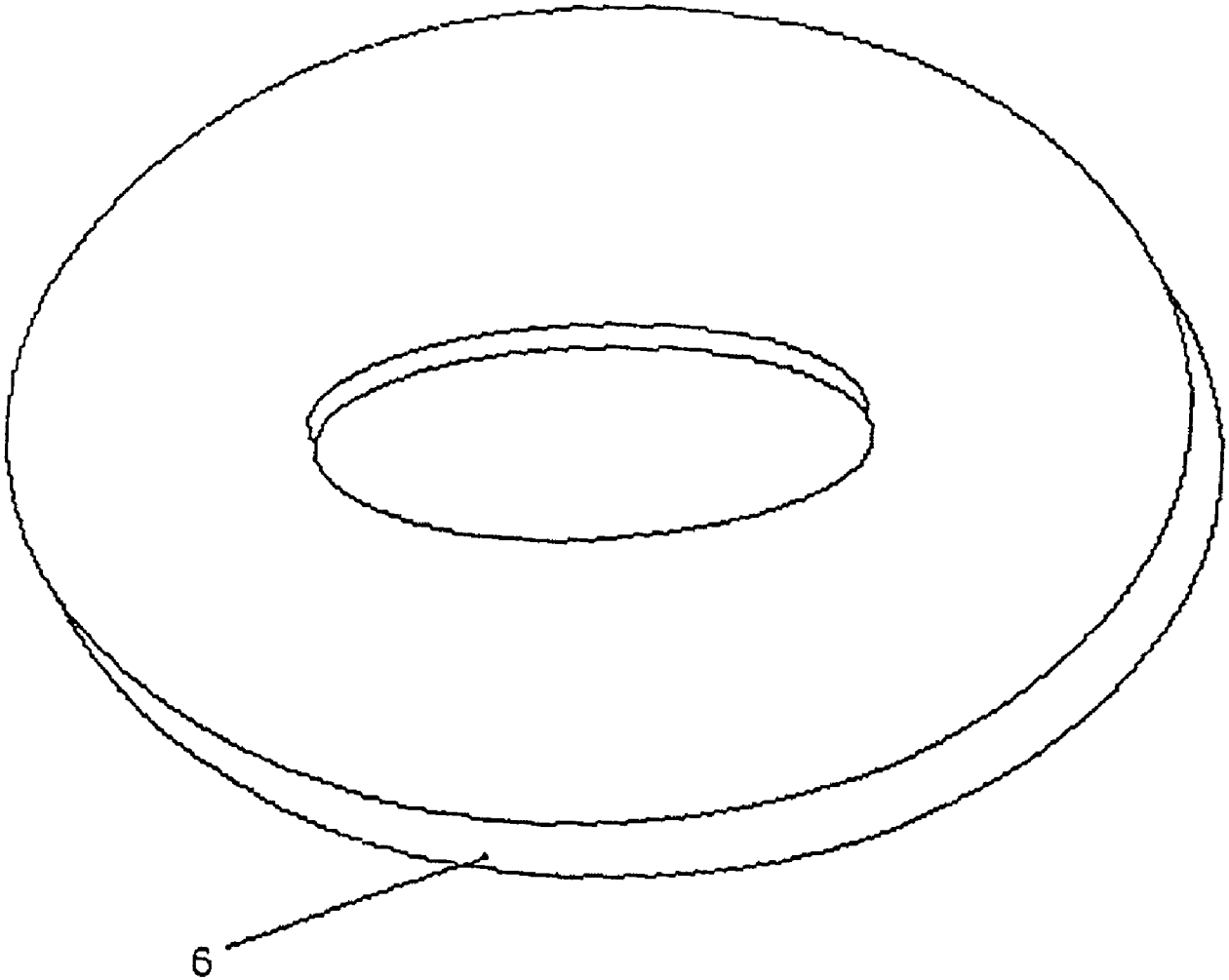
FIG. 5 shows a diagrammatic view of a preferred embodiment of the coil according to the present invention.

With reference to FIG. 5, the most advantageous shape of said transmission coil 9 is as flat as is possible; such solution allows the maximum sensibility because obviously the more distant turns are the least concerned by the secondary electromagnetic field, and therefore it is desiderable desirable for all the turns to be as close to the crystalliser 1 as possible.

Figure 6:
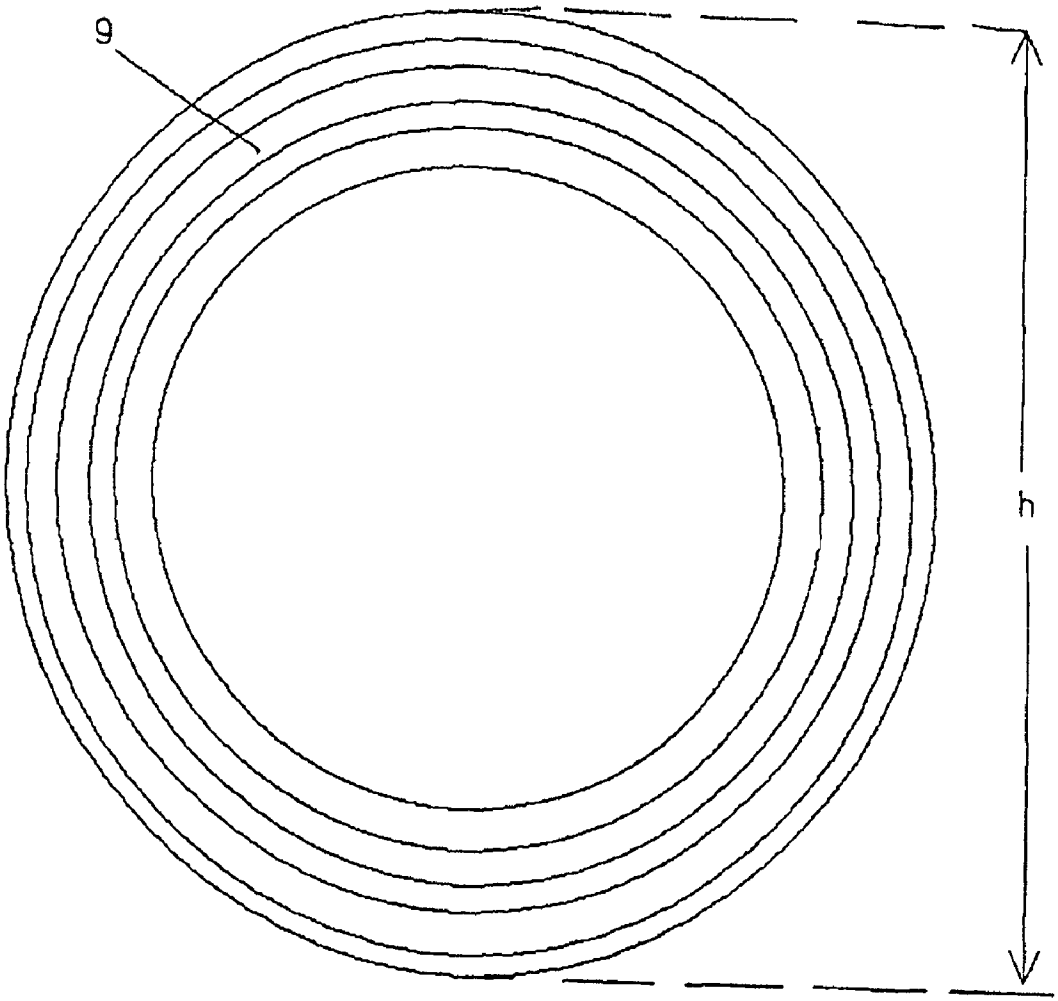
FIG. 6 shows a relative diagrammatic view of a second another preferred embodiment of the coil according to the present invention.

With reference to FIG. 6, it is also preferable that the height "h2" of the coil 9 is approximately the same as the possible variation of height of the level of the meniscus 6, because it is indeed the temperature of that portion of the crystalliser 1 to be measured, and therefore a higher height of the coil 9 would cause an undesired loss of sensitivity.

Figure 7:
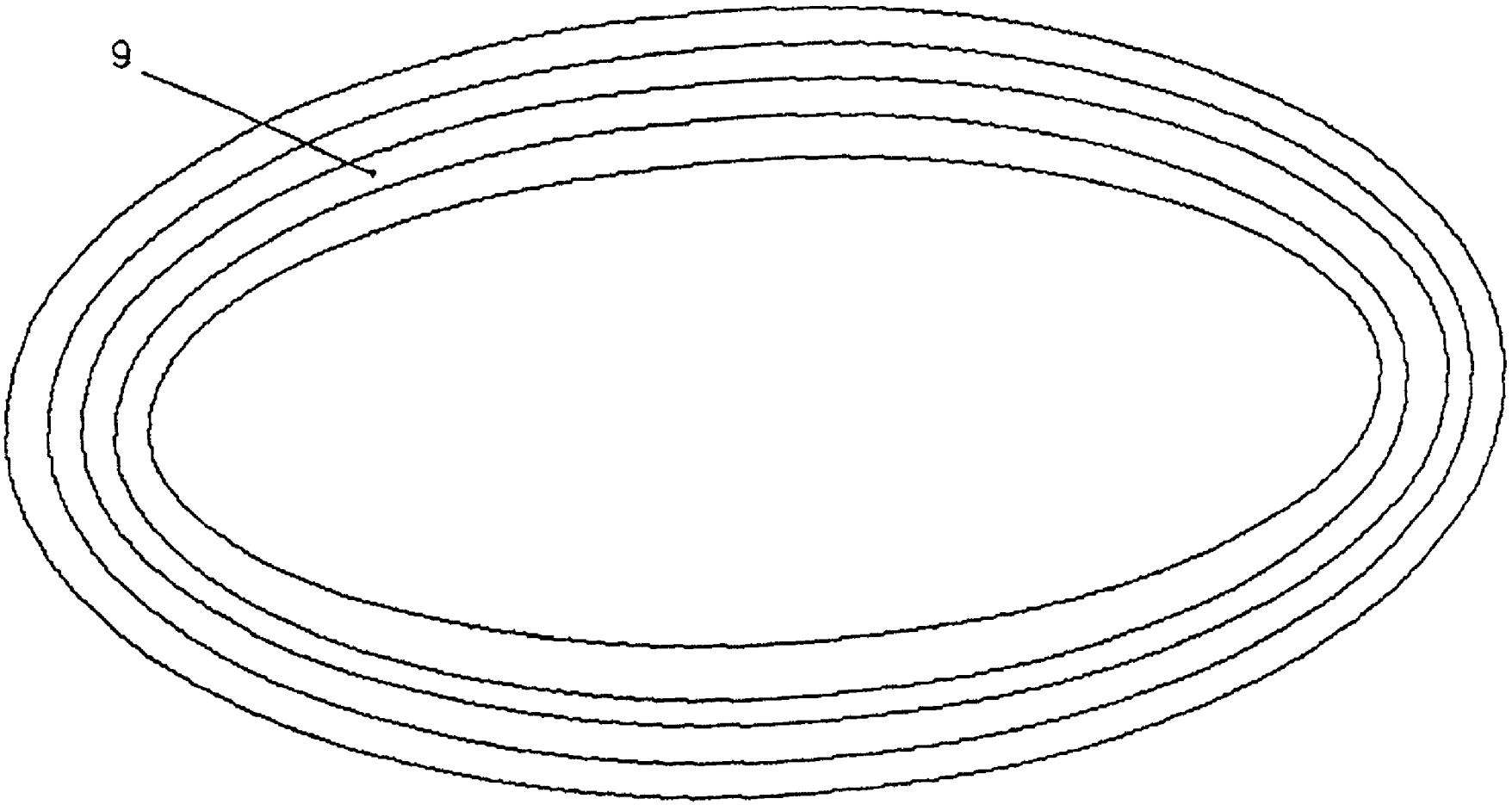
FIG. 7 shows a further diagrammatic view of a third another preferred embodiment of the coil according to the present invention.

Finally, with reference to FIG. 7, as concerns the shape of the coil 9, it is desiderable desirable that this is higher than 30 mm, and longer than 50 mm, so as to collect the maximum signal intensity and therefore improve the signal-to-noise ratio.

As a further aspect of the present invention, an algorithm may be used to detect the presence or the absence of the liquid metal in the reading field of the coil 9.

It may happen, in fact, that a variation in the temperature of the wall of the crystalliser 1 may be caused, instead of by the liquid metal in contact with it, by an undesired inclusion of solid slag or lubricating powder which is trapped in contact with the copper wall of the crystalliser 1.

In this case, the coil 9 detects a variation of the thermal field which does not correspond to an actual variation in the level or height of the meniscus.

In order to eliminate this potential drawback, the invention exploits the feature that the crystalliser 1, during the normal casting process, is made to oscillate with a fixed frequency along its vertical axis, so as to make easy the extraction of the liquid steel.

Since the coil 9 is solid with the crystalliser 1, it moves with the crystalliser 1, but also the liquid steel oscillates in an equivalent way. We have therefore a conductive body (the liquid steel) which moves close to the coil 9, so the coil 9 is crossed by a voltage which is the sum of the primary voltage generated by the feed current and the secondary voltage generated by the movement of the liquid steel, this secondary voltage being characterized by the oscillating frequency.

Since this component at the oscillating frequency is present only in the case the liquid metal is actually present inside the crystalliser 1, the system may recognize if the liquid metal is present or not, and therefore avoid the possible errors due to inclusions or trapping of material other than the liquid metal in contact with the wall of the crystalliser.

The invention claimed is:

1. A device for measuring the surface level and/or the presence of a molten metal bath in a cooled crystallizer for a continuous casting process, comprising a source of an electromagnetic field, wherein said source of an electromagnetic field is a transmission coil fed with electrical energy at a predetermined frequency, and wherein:

said transmission coil is a single transmission coil with a substantially flat shape attached to only a portion of a wall of said crystallizer, substantially astride to a foreseen level of the bath in the crystallizer, having a main axis substantially perpendicular to the main axis of said crystallizer, said coil is energized by an electrical signal at a frequency between 10 to 200 Hertz, and the information on the level and/or the presence of said surface level is obtained by processing a total impedance (Z), as measured on said transmission coil, which acts also as a receiving coil, in order to calculate a contribution to said impedance (Z) of currents induced in walls of the crystallizer, which depend on temperature of the crystallizer and, from said contribution to said impedance (Z), a value of said surface level and/or the presence of the molten metal bath.

2. The device in claim 1, wherein said processing comprises a measurement of only a reactive component of said impedance (Z) of said transmission coil.

3. The device as in claim 2, comprising record, comparison and identification means, suitable to compare said reactive component of the impedance of said transmission coil with a plurality of values contained in a pre-stored database, to each of which value are associated respective data correlated to said surface level of said molten bath and to select and produce in a substantially continuous manner information correlated to that value of said database corresponding to the reactive component which has been measured.

4. The device in claim 1, wherein said processing comprises a calculation of a phase shift between a voltage and a current in the transmission coil.

5. The device in claim 1, wherein height (h) of said transmission coil is substantially equal to a value of variation in height of a contact zone of said surface level with respect to said crystallizer.

6. The device in claim 5, wherein said transmission coil is higher than 30 mm and longer than 50 mm.

7. The device in claim 1, wherein said transmission coil is fed by a current generator.

8. The device in claim 1, wherein said transmission coil is contained within an external liner of cooling fluid of said crystallizer and arranged on an external wall of the latter.

9. A method for measuring the surface level and/or the presence of a molten metal bath in a cooled crystallizer for a continuous casting process, comprising providing a source of an electromagnetic field, wherein said source of an electromagnetic field is a transmission coil fed with electrical energy at a predetermined frequency, the method providing the following steps:

providing a single transmission coil, which acts also as a receiving coil, with a substantially flat shape and attaching said transmission coil to only a portion of a wall of said crystallizer, with a main axis substantially perpendicular to the main axis of said crystallizer, and substantially astride to the foreseen level of the liquid bath in the crystallizer, energizing said coil by an electrical signal at a frequency between 10 to 200 Hertz, and measuring an impedance (Z) of said coil, which also depends on eddy currents induced in the crystallizer by the electromagnetic field generated by the coil itself, and consequently on the resistivity of said crystallizer which, in turn, depends on the temperature of said crystallizer;

obtaining a value of a level of the meniscus of the liquid steel inside the crystallizer by comparing measured values of said impedance (Z) with predetermined values, which comprise respective known level of the meniscus.

10. The method in claim 9, providing a step of processing a phase shift between voltage and current in the transmission coil so as to obtain the information on the level and the presence of said surface level.

11. The method in claim 9, providing to measure only a reactive component of the impedance (Z) of the transmission coil.

12. The method in claim 9, wherein the crystallizer is made to oscillate at a known frequency, the method providing a step wherein a voltage is measured at terminals of said coil, and a component of said voltage having the same frequency of the oscillation of the crystallizer is isolated in order to obtain an information about the presence or the absence of liquid metal in contact with a wall of the crystallizer.

* * * * *

UNITED STATES PATENT AND TRADEMARK OFFICE

CERTIFICATE OF CORRECTION

PATENT NO. : 8,018,227 B2
APPLICATION NO. : 12/162259
DATED : September 13, 2011
INVENTOR(S) : Stefano De Monte et al.

It is certified that error appears in the above-identified patent and that said Letters Patent is hereby corrected as shown below:

Title page, Item [54] first column, in the title, "CRYSTALLISER" should read --CRYSTALLIZER--.
Title page, Item [56] second column, OTHER PUBLICATIONS, "Stahl and Eisen" should read --Stahl und Eisen--.
Title page, Item [74] second column, Attorney, Agent, or Firm, "Ecker Seamans Cherin & Mellott, LLC" should read --Eckert Seamans Cherin & Mellott, LLC--.
Column 1, line 3, "CRYSTALLISER" should read --CRYSTALLIZER--.
Column 1, line 13, "crystalliser" should read --crystallizer--.
Column 1, line 31, "i.e. the beginning" should read --i.e., the beginning--.
Column 1, line 34, "i.e. the closed" should read --i.e., the closed--.
Column 1, line 50, "also quotes discloses" should read --also discloses--.
Column 1, line 54, "crystalliser" should read --crystallizer--.
Column 1, line 56, "receiving coil.Said coils" should read --receiving coil. Said coils--.
Column 1, line 58, "crystalliser" should read --crystallizer--.
Column 1, line 63, "crystalliser" should read --crystallizer--.
Column 2, line 3, "crystalliser" should read --crystallizer--.
Column 2, line 16, "talliser" should read --tallizer--.
Column 2, line 53, "e.g. U.S. Pat. No. 4,138,888," should read --e.g., U.S. Pat. No. 4,138,888,--.
Column 2, line 54, "U.S. Pat. No. 3,336,873" should read --U.S. Pat. No. 3,366,873--.
Column 2, line 61, "suffers" should read --suffer--.
Column 3, line 12, "container. As an aspect..." should read
--container.
As an aspect...--.
Column 3, line 14, "crystalliser" should read --crystallizer--.
Column 3, line 21, "crystalliser" should read --crystallizer--.
Column 3, line 22, "crystalliser" should read --crystallizer--.
Column 3, line 23, "crystalliser" should read --crystallizer--.
Column 3, line 30, "crystalliser" should read --crystallizer--.
Column 3, line 30 (second instance), "crystalliser" should read --crystallizer--.

Signed and Sealed this
First Day of May, 2012

David J. Kappos

David J. Kappos
*Director of the United States Patent and Trademark Office*

Column 3, line 38, “preferential, non-limitative preferred, non-limiting” should read --preferred, non-limiting--.
Column 3, line 55, “view of a second” should read --view of--.
Column 3, line 58, “view of a third” should read --view of--.
Column 3, line 62, “DESCRIPTION OF SOME” should read --DESCRIPTION OF--.
Column 3, line 63, “PREFERRED EMBODIMENTS OF THE” should read --THE--.
Column 4, line 1, “crystalliser” should read --crystallizer--.
Column 4, line 3, “liser” should read --lizer--.
Column 4, line 12, “crystalliser” should read --crystallizer--.
Column 4, line 16, “crystalliser” should read --crystallizer--.
Column 4, line 19, “crystalliser” should read --crystallizer--.
Column 4, line 26, “to the Maxwell’s laws” should read --to Maxwell’s laws--.
Column 4, line 35, “i.e. the copper” should read --i.e., the copper--.
Column 4, line 37, “crystalliser” should read --crystallizer--.
Column 4, line 39, “crystalliser” should read --crystallizer--.
Column 4, line 39, “i.e. the” should read --i.e., the--.
Column 4, line 40, “instead does depend” should read --does depend--.
Column 4, line 42, “crystalliser” should read --crystallizer--.
Column 4, line 49, “the temperature the temperature” should read --the temperature--.
Column 4, line 52, “EP 0 312 788EP 0 312 799” should read --EP 0 312 799--.
Column 4, line 57, “crystalliser” should read --crystallizer--.
Column 5, line 1, “crystalliser” should read --crystallizer--.
Column 5, line 2, “crystalliser” should read --crystallizer--.
Column 5, line 4, “crystalliser” should read --crystallizer--.
Column 5, line 15, “i.e. the fact” should read --i.e., the fact--.
Column 5, line 19, “crystalliser” should read --crystallizer--.
Column 5, line 20, “and that its” should read --and its--.
Column 5, line 38, “take in be taken into account” should read --take into account--.
Column 5, line 46, “crystalliser” should read --crystallizer--.
Column 5, line 47, “crystalliser” should read --crystallizer--.
Column 5, line 50, “crystalliser” should read --crystallizer--.
Column 5, line 59, “i.e. the” should read --i.e., the--.
Column 5, line 65, “crystalliser” should read --crystallizer--.
Column 5, line 66, “crystalliser” should read --crystallizer--.
Column 6, line 3, “crystalliser” should read --crystallizer--.
Column 6, line 13, “crystalliser” should read --crystallizer--.
Column 6, line 19, “liser” should read --lizer--.
Column 6, line 26, “talliser” should read --tallizer--.
Column 6, line 41, “crystalliser” should read --crystallizer--.
Column 6, line 60, “it will be sufficient to the total impedance Z” should read --the total impedance Z--.
Column 6, line 63, “to knows known” should read --to known--.
Column 7, line 5, “crystalliser” should read --crystallizer--.
Column 7, line 13, “it is desiderable desirable” should read --it is desirable--.

Column 7, line 15, “crystalliser” should read --crystallizer--.
Column 7, line 19, “crystalliser” should read --crystallizer--.
Column 7, line 23, “it is desiderable desirable” should read --it is desirable--.
Column 7, line 31, “crystalliser” should read --crystallizer--.
Column 7, line 34, “crystalliser” should read --crystallizer--.
Column 7, line 39, “crystalliser” should read --crystallizer--.
Column 7, line 43, “crystalliser” should read --crystallizer--.
Column 7, line 53, “crystalliser” should read --crystallizer--.
Column 7, line 56, “crystalliser” should read --crystallizer--.
Claim 12, Column 10, line 3, “obtain an” should read --obtain--.